US007712287B2

(12) United States Patent
Gallimore

(10) Patent No.: US 7,712,287 B2
(45) Date of Patent: May 11, 2010

(54) COUPON INSERTION APPARATUS AND METHOD

(75) Inventor: Kent Gallimore, Ingleside, IL (US)

(73) Assignee: Gallimore Industries, Inc., Lake Villa, IL (US)

( * ) Notice: Subject to any disclaimer, the term of this patent is extended or adjusted under 35 U.S.C. 154(b) by 0 days.

(21) Appl. No.: 11/805,033

(22) Filed: May 22, 2007

(65) Prior Publication Data

US 2008/0289301 A1 Nov. 27, 2008

(51) Int. Cl.
*B65B 61/20* (2006.01)

(52) U.S. Cl. ..... 53/435; 53/55; 53/474; 225/100

(58) Field of Classification Search ..... 53/435, 53/520, 474, 55; 225/4, 100; 221/25; *B65H 35/10*
See application file for complete search history.

(56) References Cited

U.S. PATENT DOCUMENTS

| | | | | |
|---|---|---|---|---|
| 3,332,324 | A * | 7/1967 | Lehmacher et al. | 493/197 |
| 4,179,113 | A | 12/1979 | Gallimore | |
| 4,268,344 | A * | 5/1981 | Jones | 156/383 |
| 4,406,074 | A | 9/1983 | Gallimore | |
| 4,524,557 | A * | 6/1985 | Silverman et al. | 53/55 |
| 4,688,708 | A * | 8/1987 | Irvine et al. | 225/100 |
| 5,079,901 | A | 1/1992 | Kotsiopoulos | |
| 5,133,615 | A * | 7/1992 | Saito et al. | 400/621 |
| 5,427,294 | A * | 6/1995 | VandenHeuvel et al. | 225/4 |
| 5,549,233 | A | 8/1996 | Clauser | |
| 5,588,280 | A | 12/1996 | Kotsiopoulos | |
| 5,784,861 | A | 7/1998 | Kotsiopoulos | |
| 5,785,224 | A | 7/1998 | Nowakowski | |
| 5,845,462 | A | 12/1998 | Kuehl et al. | |
| 5,941,053 | A | 8/1999 | Kotsiopoulos | |
| 5,966,906 | A | 10/1999 | Kuehl et al. | |
| 6,082,079 | A | 7/2000 | Kuehl et al. | |
| 6,722,108 | B1 | 4/2004 | Kotsiopoulos | |
| 2008/0098696 | A1 * | 5/2008 | Gallimore | 53/435 |

FOREIGN PATENT DOCUMENTS

| | | | |
|---|---|---|---|
| GB | 2379918 | A * | 3/2003 |
| JP | 07330205 | A * | 12/1995 |

* cited by examiner

*Primary Examiner*—Thanh K Truong
(74) *Attorney, Agent, or Firm*—Carmen Patti Law Group, LLC

(57) ABSTRACT

An apparatus in one embodiment has: a positioning functionality that sequentially locates, at a predefined bight, coupons of a continuous web of coupons; a burst functionality whereby a foremost coupon is separated at the predefined bight from a next coupon of the continuous web of coupons; a staging functionality whereby the separated foremost coupon is moved to a staging position; and an insertion functionality whereby the first coupon is inserted into a container. In another embodiment the first coupon is inserted into a container only after the next coupon is separated from the continuous web. In another embodiment after the second coupon is sensed, the first coupon is burst and inserted into a container.

25 Claims, 7 Drawing Sheets

COUPON INSERTION APPARATUS AND METHOD

TECHNICAL FIELD

The invention relates generally to insertion devices and methods and, more specifically, to separating coupons from a continuous coupon web and inserting the separated coupons into containers.

BACKGROUND

The goal of coupon inserters is to consistently place coupons into bags of cereal, candy, rice, coffee, and snack food, and into boxes and packages of pretzels, pasta, cookies, crackers, and more. Inserters operate at speeds over 300 pieces per minute, utilizing the continuous perforated or non-perforated coupon format. Known inserters can be utilized to insert both overwrapped and non-overwrapped pieces in a bandolier or roll format.

Reliability and consistency is extremely important for coupon insertion at the high rates of speed that are required. Such reliability and consistency needs improvement in the area of coupon inserters that use a bursting operation to remove a coupon from a coupon web and then insert the coupon into a container.

Thus, there is a need in the art for an improved coupon inserter.

SUMMARY

One embodiment of the present method and apparatus encompasses an apparatus. This embodiment of the apparatus may comprise: a feeding roll assembly and a burst roll assembly that defines a predefined bight whereby a foremost coupon is separated at the predefined bight from a next coupon of a continuous web of coupons; and a coupon sensor located before the feeding roll assembly and for locating, at the predefined bight, coupons of the continuous web of coupons.

A further embodiment of the present method and apparatus encompasses an apparatus. This embodiment of the apparatus may comprise: a positioning functionality that sequentially locates, at a predefined bight, coupons of a continuous web of coupons; a burst functionality whereby a foremost coupon is separated at the predefined bight from a next coupon of the continuous web of coupons; a staging functionality whereby the separated foremost coupon is moved to a staging position; and an insertion functionality whereby the first coupon is inserted into a container only after the next coupon is separated from the continuous web.

Another embodiment of the present method and apparatus encompasses a method. This embodiment of the method may comprise: sequentially positioning, at a predefined bight, coupons of a continuous web of coupons; bursting at the predefined bight a foremost coupon from a next coupon of the continuous web of coupons; moving the separated foremost coupon to a staging position; bursting at the predefined bight the second coupon from a further coupon of the continuous web of coupons; and inserting the first coupon into a container. In a further embodiment the first coupon is inserted into a container only after the next coupon is separated from the continuous web.

DESCRIPTION OF THE DRAWINGS

The features of the embodiments of the present method and apparatus are set forth with particularity in the appended claims. These embodiments may best be understood by reference to the following description taken in conjunction with the accompanying drawings, in the several figures of which like reference numerals identify like elements, and in which:

DETAILED DESCRIPTION

Inserts and containers containing the inserts are well known. An insert may take various forms and may be any coupon, card, sheet, receipt, warranty, premium or other part that may be advantageously handled as described hereinafter. In the following the term "coupon" will be used as representative of any form of an insert. Also, an insert may be two-dimensional or three-dimensional. Furthermore, a container may be any type of container, such as boxes, tubs, cans and vessels of all kinds as well as any other coupon-receiver which can advantageously be used as described hereinafter.

Figure 1:
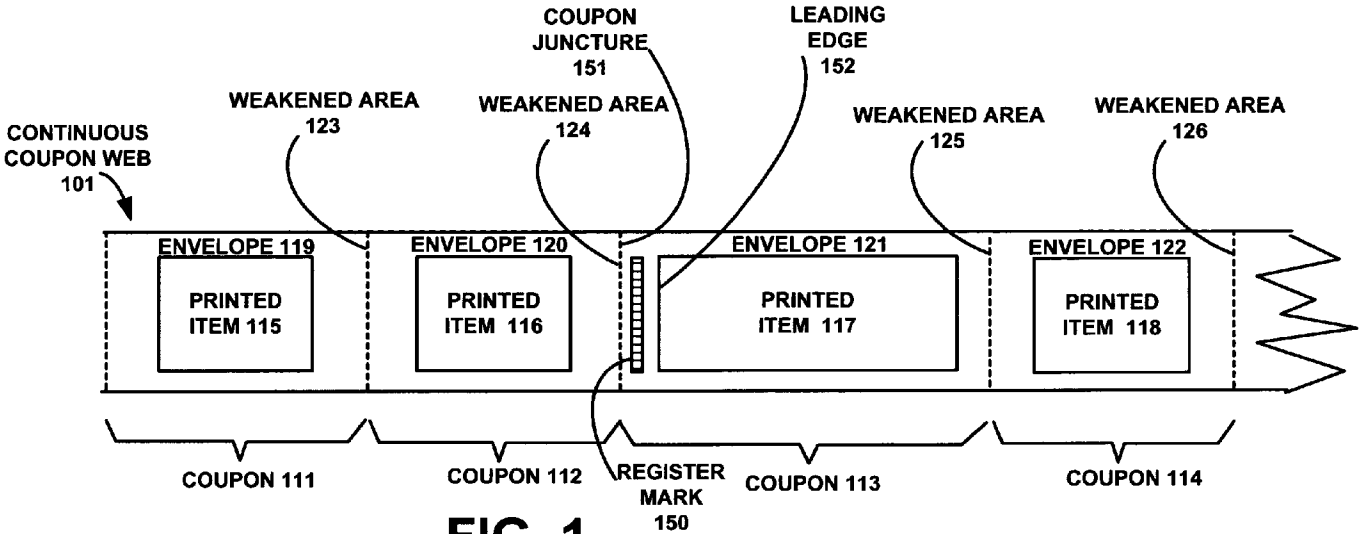
FIG. 1 depicts one embodiment of a continuous coupon web.

FIG. 1 depicts one embodiment of a continuous coupon web. In this embodiment the coupons 111-114 may be contained in a continuous web 101. Each coupon 111-114 may comprise, for example, a printed item 115-118 respectively enclosed in an envelope 119-122 (also referred to as an overwrap), which may be made of cellophane, plastic, etc. The coupons 111-114 may be temporarily coupled to one another via a perforated or weakened areas 123-126. Also, the coupons 111-114 may be of unequal lengths, that is some coupons may be longer than other coupons. For example, coupon 113 is depicted as being longer than coupons 111, 112 and 114. It is a feature of embodiments according to the present method and apparatus that different lengths of coupons are automatically handled without any need to change the structure of the embodiments or by re-programming the embodiments. Also in embodiments according to the present method and apparatus a coupon sensor may sense a leading edge 152 of the printed item 117 in the coupon 113, a juncture 151 between coupons 112 and 113, and a register mark 150 on the coupon 113.

Figure 2:
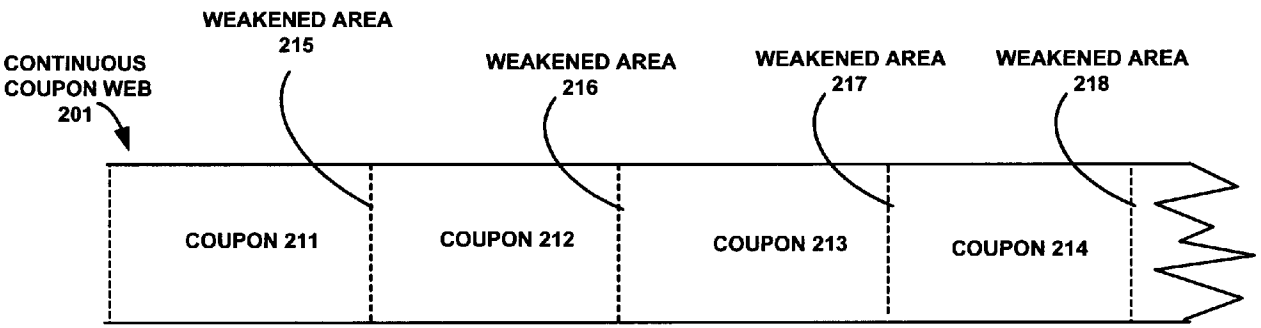
FIG. 2 depicts another embodiment of a continuous coupon web.

FIG. 2 depicts another embodiment of a continuous coupon web 201. In this embodiment coupons 211-214 are coupled to one another by perforated or weakened areas 215-218. Other materials and configurations of the coupons may be utilized. Typically, the continuous coupon web 201 may be stored on a reel or may have a fan-fold configuration and be stored in a box.

Figure 3:
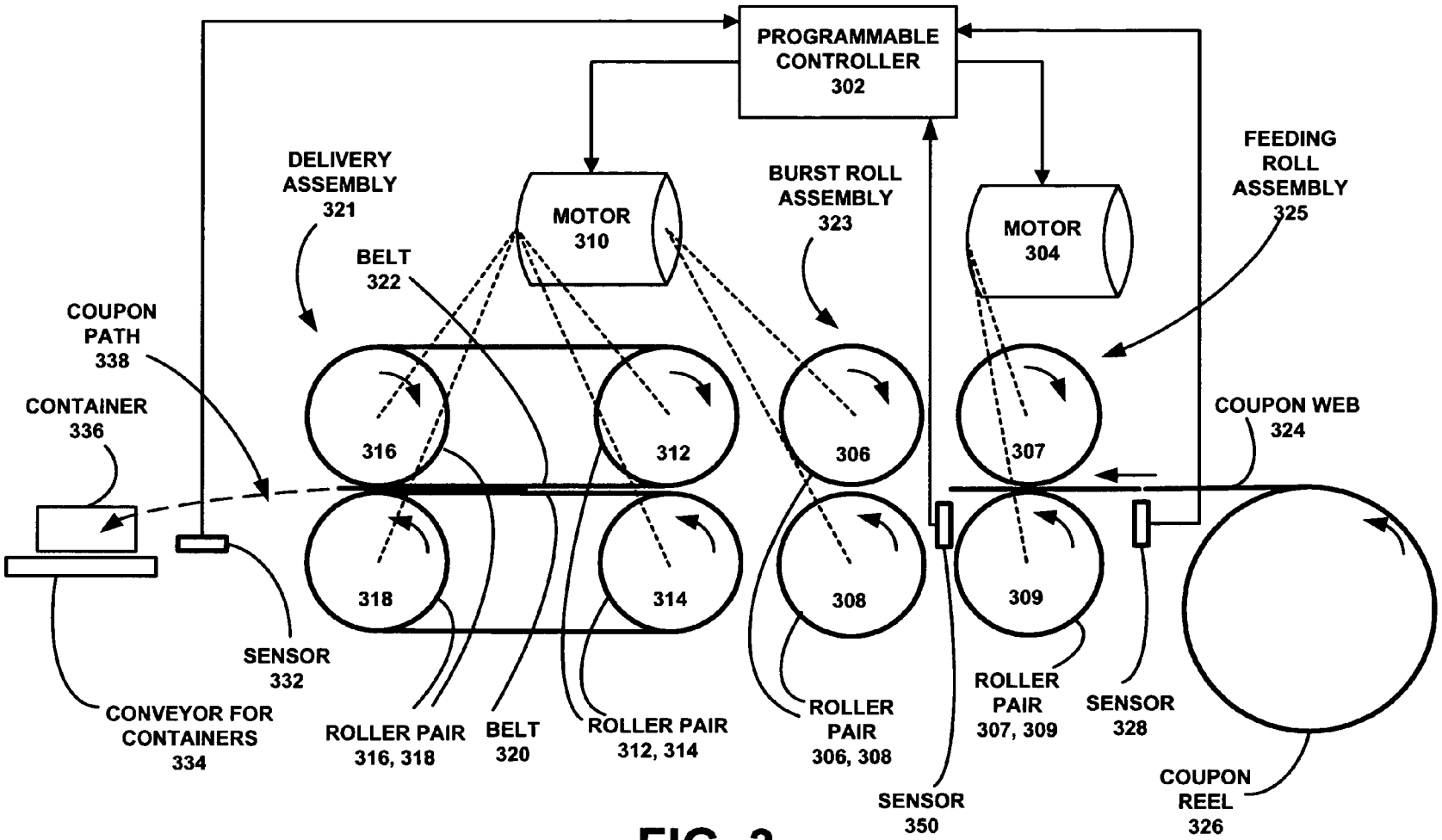
FIG. 3 schematically depicts one view on an embodiment of a coupon insertion device according to the present method and apparatus.

FIG. 3 depicts one view on an embodiment of a coupon insertion device according to the present method and apparatus. This embodiment may have a delivery assembly 321 that includes roller pairs 316, 318, 312, 314 and belts 320, 322, a burst roll assembly 323 that includes roller pair 306, 308, and a feeding roll assembly 325 that includes roller pair 307, 309. The feeding roll assembly 325 may receive a leading edge of a foremost coupon of a coupon web 324, and may be driven by an intermittent positioning drive motor system 304 at a predetermined speed. The delivery assembly 321 and the burst roll assembly 323 may be driven by an intermittent feeding drive motor system 310. A foremost coupon may be separated from a next coupon of the continuous web 324 by stopping or slowing the roller pair 307, 309 relative to the driven roller pair 306, 308 to effect a bursting operation.

A programmable controller 302 or other equivalent control device may be operatively coupled to the motor systems 304 and 310. In general the programmable controller may be programmed such that the embodiment depicted in FIG. 3 may have: a positioning functionality that sequentially locates, at a predefined bight, coupons of a continuous web of coupons; a burst functionality whereby a foremost coupon is separated at the predefined bight from a next coupon of the continuous web of coupons; a staging functionality whereby the separated foremost coupon is moved to a staging position; and an insertion functionality whereby the first coupon is inserted into a container only after the next coupon is separated from the continuous web.

The programmable controller 302 may be coupled to at least a coupon sensor 328 and a container sensor 332. The coupon sensor 328 detects the coupons that are attached to the coupon web 324 that may be stored on a coupon reel 326. Information from the coupon sensor 328 may be utilized for effecting the positioning functionality, the burst functionality, and the staging functionality. A further sensor 350 may be provided for detecting jams and may also be operatively coupled to the programmable controller 302.

The container sensor 332 detects a container 336 on a conveyor 334 for containers. Alternatively, other equipment (not shown) in a production line may supply information regarding the moving container. Information from the container sensor 334 may be utilized in effecting the insertion functionality whereby, in one embodiment, a foremost coupon is inserted into a container only after a next coupon is separated from the continuous web. A coupon may be ejected from the delivery roll assembly 321 along coupon path 338 and into the container 336 as the container 336 travels along the conveyor 334. This results in increased reliability and operation of inserting coupons in containers.

Figure 4:
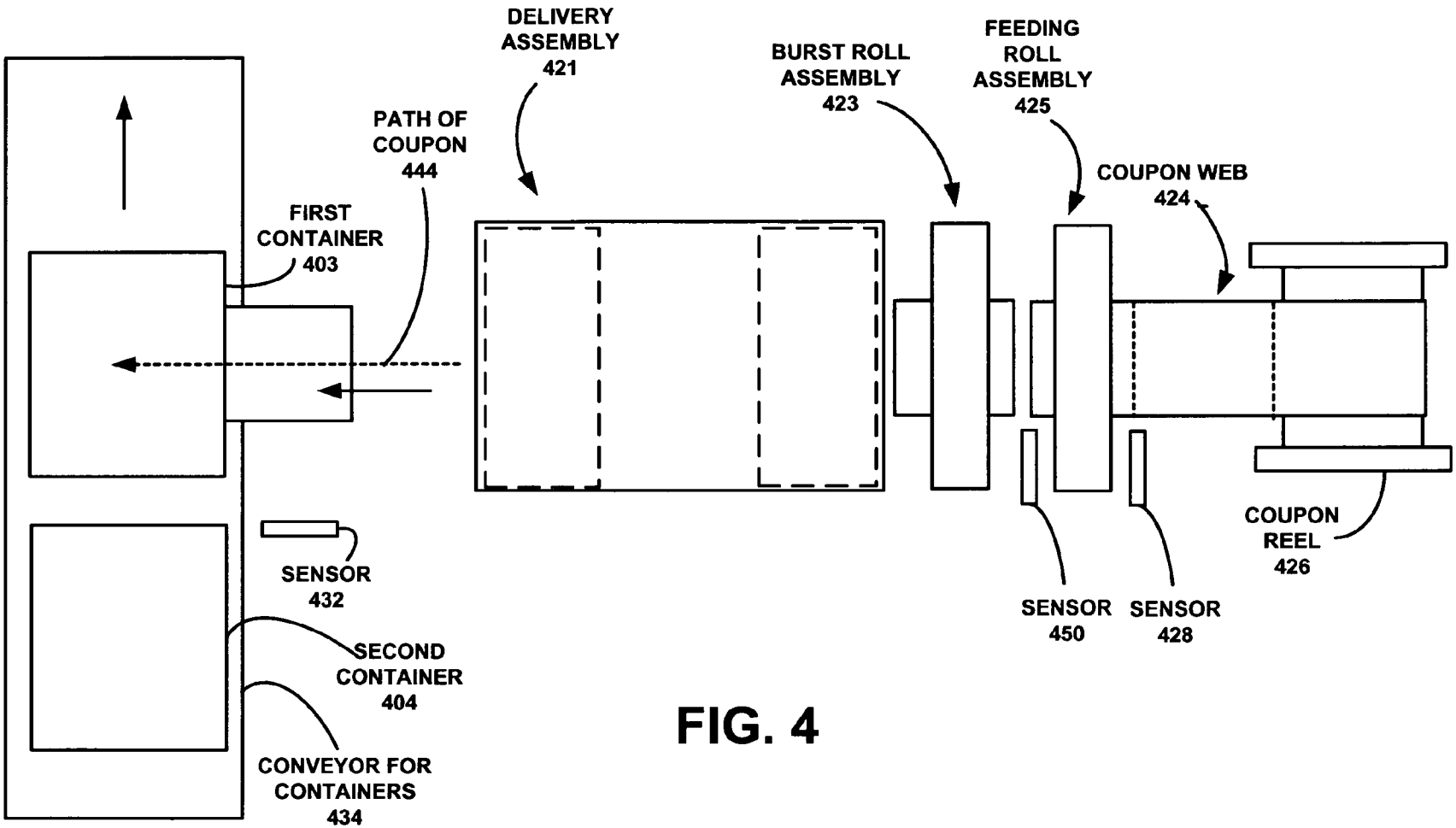
FIG. 4 schematically depicts another view on an embodiment of a coupon insertion device according to the present method and apparatus.

FIG. 4 depicts another view of the FIG. 3 embodiment of a coupon insertion device according to the present method and apparatus. A coupon web 424 is supplied from a coupon reel 426 to a feeding roll assembly 425. Sensors 428, 432 and 450 operate as described above in FIG. 3.

As depicted in FIG. 4 a foremost coupon may be ejected along path 444 from the delivery assembly 421 toward an approaching first container 403 on a conveyor for containers 434. In one embodiment, before the foremost coupon reaches the first container 403, the next coupon is separated from the coupon web 424. This next coupon will eventually be inserted into the second container 404.

Figure 5:
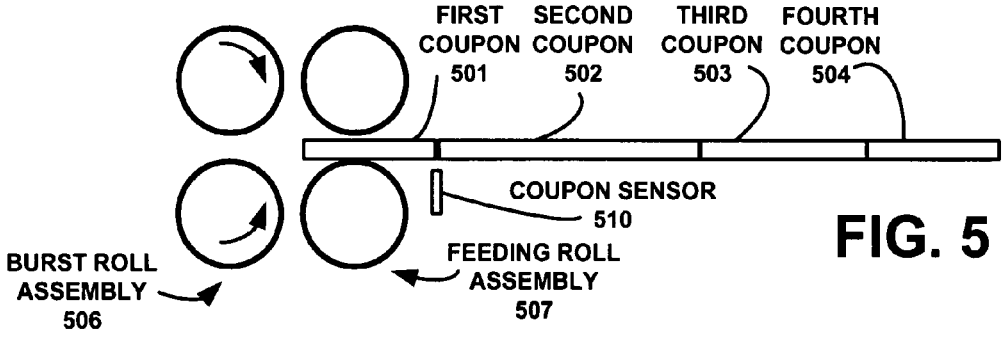
FIGS. 5-9 depict one embodiment of feeding and bursting operations according to the present method and apparatus.

FIGS. 5-9 depict one embodiment of feeding and bursting operations according to the present method and apparatus. In FIG. 5 first, second, third, and fourth coupons 501, 502, 503, 504 are fed to a feeding roll assembly 507. The juncture of the first and second coupons 501, 502 or alternatively the leading edge of the second coupon 502 may be sensed by the coupon sensor 510. At this stage of operation the feeding roll assembly 507 is stopped. The burst roll assembly 506 may be continuously rotating in one embodiment or may be turned on and off at different stages of operations in another embodiment. This is referred to as indexing.

Figure 6:
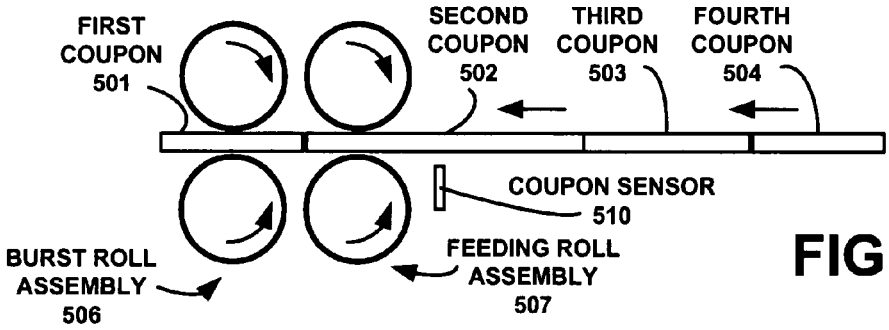

In FIG. 6 the feeding roll assembly 507 is turned on which advances the first, second, third, and fourth coupons 501, 502, 503, 504 approximately a predetermined distance such that a juncture of the first and second coupons 501, 502 is positioned between the feeding roll assembly 507 and the burst roll assembly 506.

Figure 7:
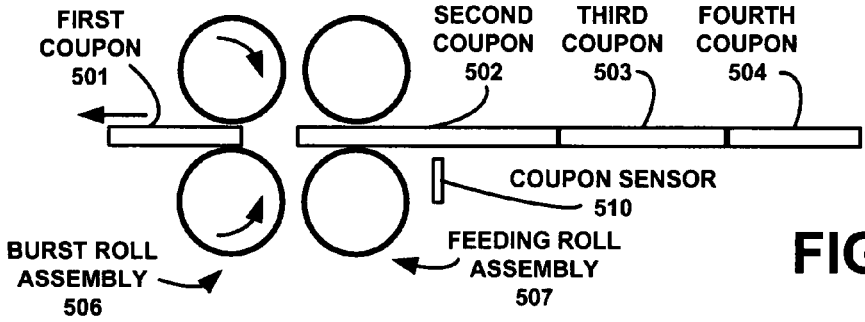

In FIG. 7 the feeding roll assembly 507 is turned off which causes the first coupon 501 to be separated from the second coupon 502 in a burst operation. The burst roll assembly 506 continues to run and move the first coupon 501.

Figure 8:
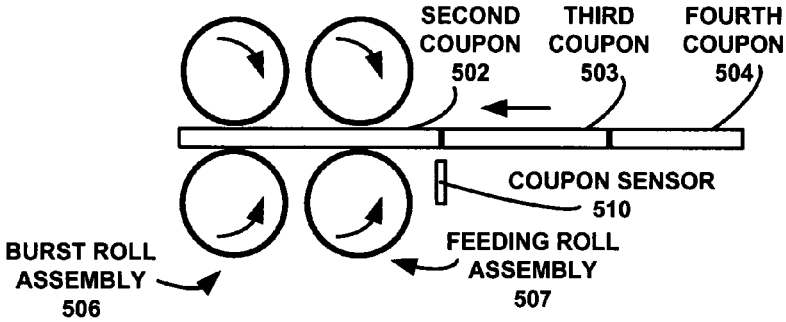

In FIG. 8 the feeding roll assembly 507 is again turned on which advances the second, third, and fourth coupons 502, 503, 504. After the coupon sensor 510 detects the juncture of the second and third coupons 502, 503, the second, third, and fourth coupons 502, 503, 504 are advanced approximately predetermined distance such that the juncture of the second and third coupons 502, 503 is positioned between the feeding roll assembly 507 and the burst roll assembly 506.

Figure 9:
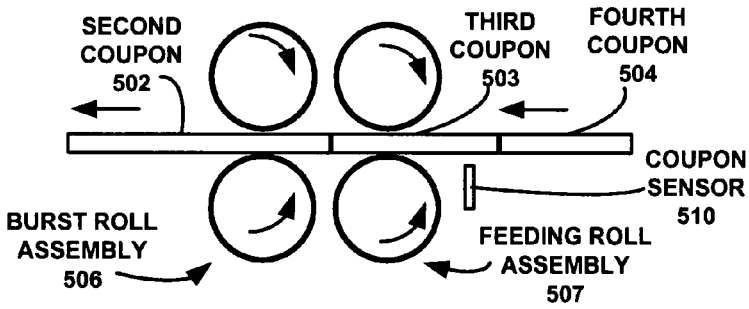

In FIG. 9 the juncture of the second and third coupons 502, 503 is positioned between the feeding roll assembly 507 and the burst roll assembly 506. The operation now repeats with the bursting of the second and third coupons 502, 503. This operation my be used with a continuous running burst roll assembly 506 or an indexing burst roll assembly 506. It also may be used with sequential coupons of varying lengths in a coupon web. It may further be used with systems in which a foremost coupon is inserted into a container only after a next coupon is separated from the continuous web, or in a system in which a foremost coupon is inserted into a container before a next coupon is separated from the continuous web.

FIGS. 10-13 depict operation according to the present method and apparatus for inserting a coupon into a container. In each of the FIGS. 10-13 a continuous web of coupons 505 having first, second, third, and fourth coupons 501, 502, 503, 504 is supplied to a feeding roll assembly 507. In the each of the coupons is separated in a burst function from the continuous web of coupons 505. The burst operation may be effected as described above with a burst roll assembly 506 and the feeding roll assembly 507. Each of the coupons is then transferred to a delivery roll assembly 508. At least two sensors, a coupon sensor 510 and a container sensor 512, are provided. It is to be understood that the information supplied by these sensors may be, alternatively, supplied by other inputs in the overall system. The first, second, and third coupons 501, 502, 503, for example, may also be referred to as a foremost coupon, a next coupon, and a further coupon.

Figure 10:
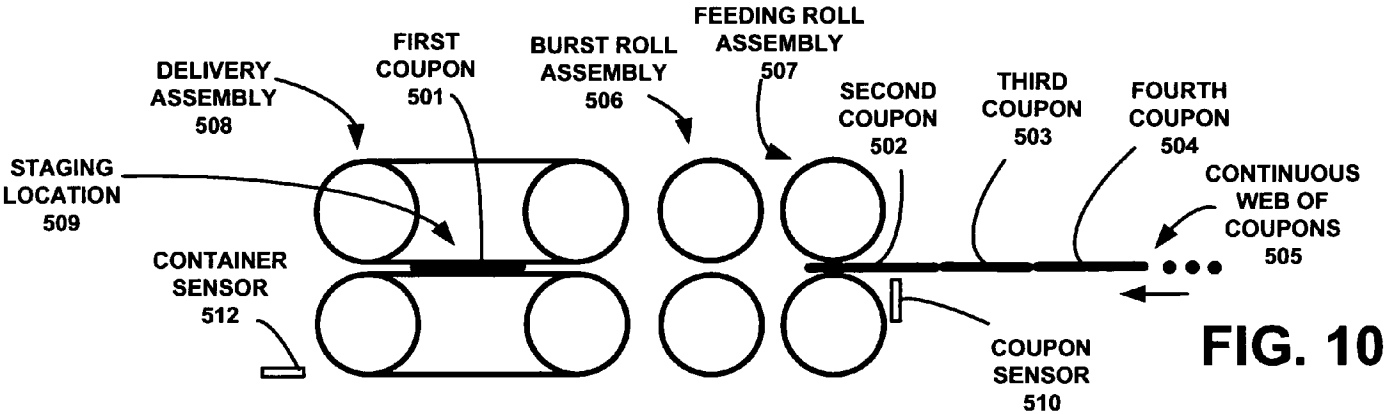
FIGS. 10-13 depict one embodiment for insertion of coupons into containers according to the present method and apparatus.

In FIG. 10 the feeding roll assembly 508 has advanced the first coupon 501 to a staging location 509. The staging location may be at other locations, such as at either end of the feeding roll assembly 508.

Figure 11:
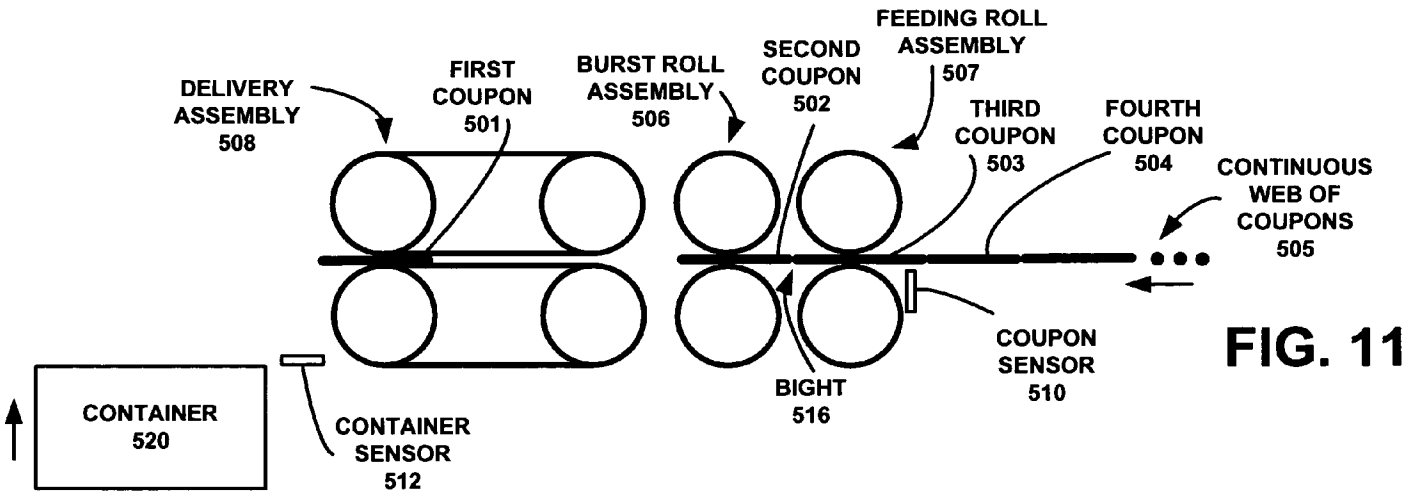

In FIG. 11 the second, third and fourth coupons 502, 503, 504 of the continuous web of coupons 505 are advanced such that a juncture of the second coupon 502 and the third coupon 503 is positioned at a bight 516 defined by the burst roll assembly 506 and the feeding roll assembly 508. A container 520 is detected by the container sensor 512 and the delivery assembly 508 begins to move the first coupon 501 out of the delivery assembly 508.

Figure 12:
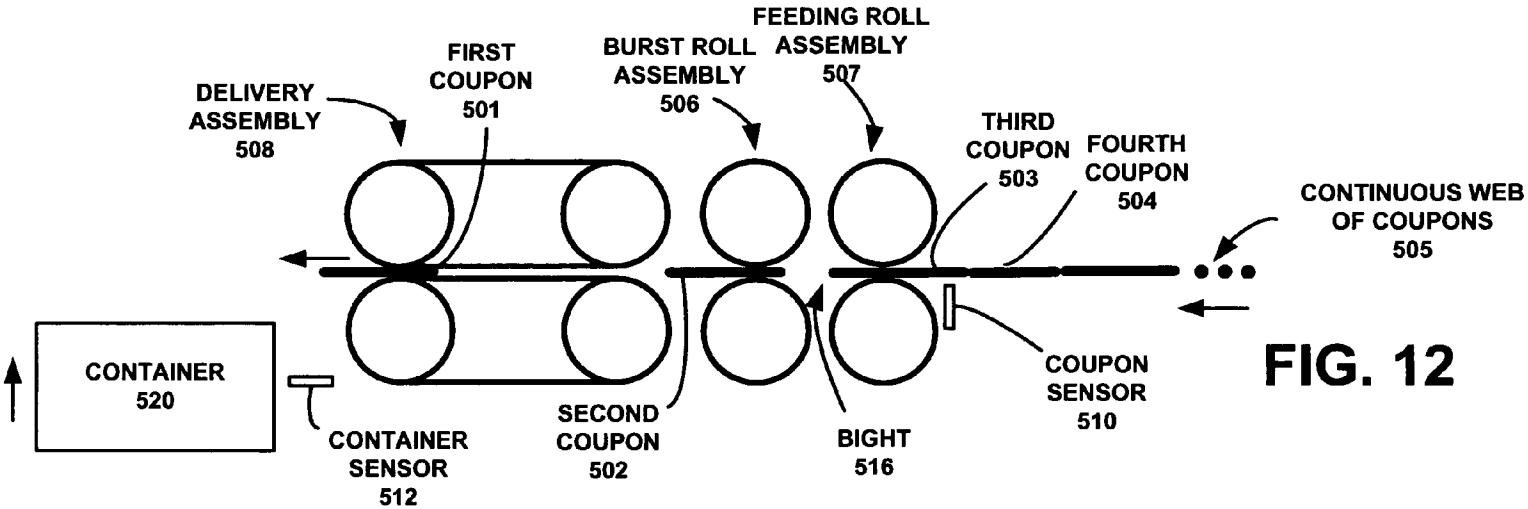

In FIG. 12 the second coupon 502 is separated from the third coupon 503 in a burst function and the first coupon 501 continues to move out of the delivery assembly 508. The container 520 continues to move as depicted.

Figure 13:
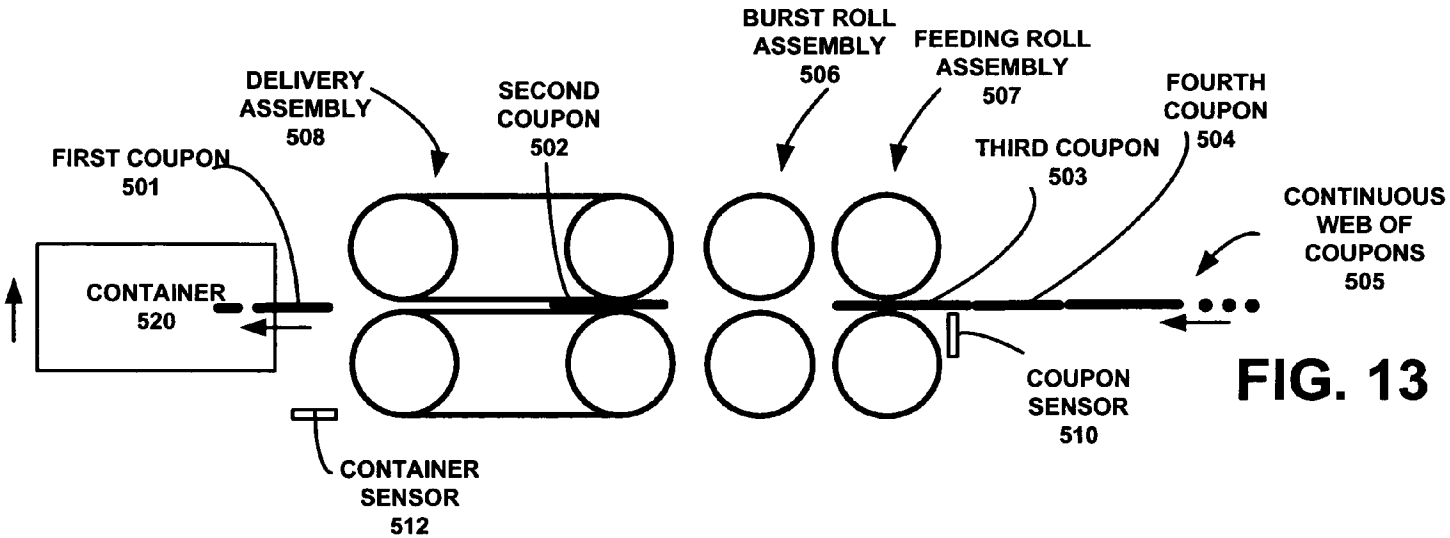

In FIG. 13 the first coupon 501 is inserted into the container 520, and the second coupon 502 moves toward the staging location 509 in the delivery assembly 508. The process continues as described above with the approach of another container.

Some of the operations described in FIGS. 10-13 may occur substantially simultaneously or in a different order. In the depicted embodiment the first coupon is inserted into a container only after the next coupon is separated from the continuous web.

Figure 14:
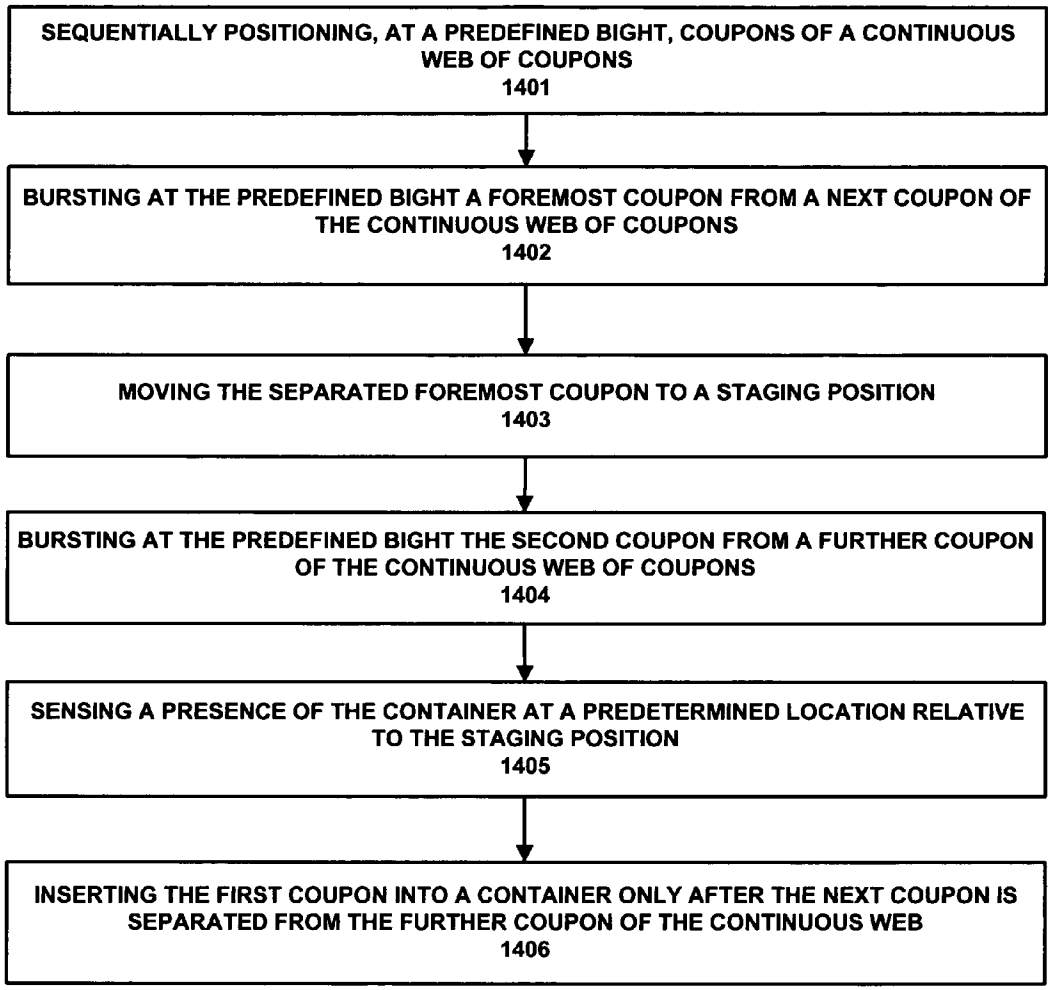
FIG. 14 is a flow diagram depicting operation of an embodiment of a coupon insertion device according to the present method and apparatus.

FIG. 14 depicts an embodiment according to the present method and apparatus that may have the following steps: sequentially positioning, at a predefined bight, coupons of a continuous web of coupons (1401); bursting at the predefined bight a foremost coupon from a next coupon of the continuous web of coupons (1402); moving the separated foremost coupon to a staging position (1403); bursting at the predefined bight the second coupon from a further coupon of the continuous web of coupons (1404); sensing a presence of a container at a predetermined location relative to the staging position (1405); and inserting the first coupon into the container only after the next coupon is separated from the further coupon of the continuous web (1406). In this embodiment the foremost coupon may be ejected from the feeding roll assembly such that the foremost coupon is inserted into the container, wherein the container is moving at a predetermined speed.

One embodiment according to the present method and apparatus may further have the steps of sensing, by the coupon sensor at a coupon sensor location, a leading edge of a respective coupon of the continuous web of coupons, and, in response to the sensing of the leading edge of the respective coupon, advancing the respective coupon a predetermined distance from the coupon sensor location such that the leading edge of the respective coupon is positioned at the predefined bight.

The continuous web of coupons may have at least two coupons having different lengths, or the continuous web of coupons may have a plurality of coupons having different lengths.

The present apparatus in one example may comprise a plurality of components such as one or more of electronic components, hardware components, and computer software components. A number of such components may be combined or divided in the apparatus.

The present method and apparatus are not limited to the particular details of the depicted embodiments and other modifications and applications are contemplated. Certain other changes may be made in the above-described embodiments without departing from the true spirit and scope of the present method and apparatus herein involved. It is intended, therefore, that the subject matter in the above depiction shall be interpreted as illustrative and not in a limiting sense.

I claim:

1. An apparatus, comprising:

a positioning functionality that sequentially locates, at a predefined bight, coupons of a continuous web of coupons;

a burst functionality effecting a foremost coupon being separated at the predefined bight from a next coupon of the continuous web of coupons;

a staging functionality effecting the separated foremost coupon being moved to a staging position; and an insertion functionality effecting the first coupon being inserted into a container only alter the next coupon is separated from the continuous web;

a feeding roll assembly and a burst roll assembly that define the predefined bight;

a coupon sensor located before the feeding roll assembly and for locating, at the predefined bight, coupons of the continuous web of coupons, a respective coupon moving in a direction such that a leading edge of the respective coupon passes the coupon sensor before the respective coupon reaches the feeding roll assembly;

a predetermined distance, the predetermined distance defined as a distance from a location of the coupon sensor to a location of the predefined bight, and leading edge of the respective coupon being detected by the coupon sensor and moved to the location of the bight irrespective of a length of the coupon;

a delivery assembly operatively coupled to the burst roll assembly, the delivery assembly defining the staging position; and a controller operatively coupled to the coupon sensor, the feeding roll assembly, the burst roll assembly and the delivery assembly.

2. The apparatus according to claim 1, wherein the burst functionality effects a breaking of the foremost coupon from a next coupon of the continuous web at a predefined attachment juncture of the foremost coupon and the next coupon.

3. The apparatus according to claim 2, wherein the staging functionality effects movement, by the delivery assembly, of the separated foremost coupon to the staging position.

4. The apparatus according to claim 3, wherein the insertion functionality effects insertion of the foremost coupon into a moving container only after the next coupon is separated from the continuous web.

5. The apparatus according to claim 1, wherein the coupon comprises a printed item contained in an envelope.

6. The apparatus according to claim 1, wherein the apparatus further comprises a container sensor operatively coupled to the controller, the container sensor sensing the presence of the container.

7. The apparatus according to claim 1, wherein the positioning functionality comprises a sensing by the coupon sensor at a coupon sensor location of a leading edge of a respective coupon of the continuous web, and an advancement of the respective coupon a predetermined distance from the coupon sensor location such that the leading edge of the respective coupon is positioned at the predefined bight.

8. The apparatus according to claim 7, wherein the continuous web of coupons have at least two coupons having different lengths.

9. The apparatus according to claim 7, wherein the continuous web of coupons have a plurality of coupons having different lengths.

10. An apparatus, comprising:

a feeding roll assembly and a burst roll assembly that defines a predefined bight whereby a foremost coupon is separated at the predefined bight from a next coupon of a continuous web of coupons;

a coupon sensor located before the feeding roll assembly and for locating, at the predefined bight, coupons of the continuous web of coupons, a respective coupon moving in a direction such that a leading edge of the respective coupon passes the coupon sensor before the respective coupon reaches the feeding roll assembly;

a predetermined distance, the predetermined distance defined as a distance from a location of the coupon sensor to a location of the predefined bight, and leading edge of the respective coupon being detected by the coupon sensor and moved to the location of the bight irrespective of a length of the coupon;

a delivery assembly operatively coupled to the burst roll assembly, the delivery assembly defining a staging position for separated coupons from the continuous web of coupons; and a controller operatively coupled to the coupon sensor, the feeding roll assembly, the burst roll assembly and the delivery assembly;

the first coupon being inserted into a container only after the next coupon is separated from the continuous web.

11. The apparatus according to claim 10, wherein the coupon comprises a printed item contained in an envelope.

12. The apparatus according to claim 10, wherein the feeding roll assembly is driven by an intermittent feeding drive.

13. The apparatus according to claim 10, wherein the foremost coupon is separated from the next coupon of the continuous web at a predefined attachment juncture of the foremost coupon and the next coupon.

14. The apparatus according to claim 10, wherein the apparatus further comprises a container sensor operatively coupled to the controller, the container sensor sensing the presence of the container.

15. The apparatus according to claim 10, wherein the coupon sensor at a coupon sensor location senses a respective coupon of the continuous web, and wherein, in response to die sensing of the respective coupon, the respective coupon is advanced a predetermined distance from the coupon sensor location such that a leading edge of the respective coupon is positioned at the predefined bight.

16. The apparatus according to claim 10, wherein the continuous web of coupons have at least two coupons having different lengths.

17. The apparatus according to claim 10, wherein the continuous web of coupons have a plurality of coupons having different lengths.

18. An apparatus, comprising:

a path along which coupons travel, the path having located thereon a source of coupons, followed next by a coupon sensor at a coupon sensor location, followed next by a feeding roll assembly, followed next by a burst roll assembly, followed next by a delivery assembly, followed next by a container sensor at a container sensor location, and followed next by a coupon insertion location;

the feeding roll assembly and a the burst roll assembly defining a predefined bight whereby a foremost coupon is separated at the predefined bight from a next coupon of a continuous web of coupons;

a predetermined distance that is a separation between the predefined bight and the coupon sensor location;

the coupon sensor at the coupon sensor location sensing a leading edge of a respective coupon of the continuous web, and, in response to sensing the leading edge of the respective coupon, the respective coupon being advanced the predetermined distance from the coupon sensor location such that the leading edge of the respective coupon is positioned at the predefined bight;

the delivery assembly operatively coupled to the burst roll assembly, the delivery assembly defining a staging position for separated coupons from the continuous web of coupons;

the container sensor sensing the presence of a container at a predetermined container location;

a first drive motor system operatively coupled to the feeding roll assembly;

a second drive motor system operatively coupled to the delivery assembly and the burst roll assembly;

a controller operatively coupled to the coupon sensor, the feeding roll assembly, the burst roll assembly, the delivery assembly and the container sensor;

a respective foremost coupon being separated from a respective next coupon of the continuous web by reducing a speed of a roller pair in the feeding roll assembly relative to a speed of a roller pair in the burst roll assembly to effect a bursting operation and the respective foremost coupon being inserted into a container only after the respective next coupon is separated from the continuous web.

19. The apparatus according to claim 18, wherein the path along which coupons travel, the path has located thereon only the source of coupons, followed next by the coupon sensor at the coupon sensor location, followed next by the feeding roll assembly, followed next by the burst roll assembly, followed next by the delivery assembly, followed next by the container sensor at a container sensor location, and followed next by the coupon insertion location.

20. The apparatus according to claim 18, wherein the coupon comprises a printed item contained in an envelope.

21. The apparatus according to claim 18, wherein the first motor system is an intermittent drive motor system.

22. The apparatus according to claim 18, wherein the foremost coupon is separated from the next coupon of the continuous web at a predefined attachment juncture of the foremost coupon and the next coupon.

23. The apparatus according to claim 18, wherein the second motor system is an intermittent positioning drive motor system operating at a predetermined speed.

24. The apparatus according to claim 18, wherein the continuous web of coupons have at least two coupons having different lengths.

25. The apparatus according to claim 18, wherein the continuous web of coupons have a plurality of coupons having different lengths.

* * * * *